US008926169B1

(12) United States Patent
Leung

(10) Patent No.: US 8,926,169 B1
(45) Date of Patent: Jan. 6, 2015

(54) TIMEPIECE CASE AND TIMEPIECE INCORPORATING THE SAME

(71) Applicant: Frankie Leung, Hong Kong (CN)

(72) Inventor: Frankie Leung, Hong Kong (CN)

(73) Assignee: Aqua Master Ltd., New York, NY (US)

( * ) Notice: Subject to any disclaimer, the term of this patent is extended or adjusted under 35 U.S.C. 154(b) by 0 days.

(21) Appl. No.: 14/045,969

(22) Filed: Oct. 4, 2013

(51) Int. Cl.
*G04B 39/00* (2006.01)
*G04B 19/28* (2006.01)
*G04B 37/00* (2006.01)

(52) U.S. Cl.
CPC ..... *G04B 19/283* (2013.01); *G04B 37/0008* (2013.01)
USPC ..... 368/295; 368/281

(58) Field of Classification Search
USPC ..... 368/279, 294–295, 313, 281; 24/132 R; 64/24, 29.1
See application file for complete search history.

(56) References Cited

U.S. PATENT DOCUMENTS

| | | | | |
|---|---|---|---|---|
| 2,430,508 | A * | 11/1947 | Holl | 63/15 |
| 2,608,049 | A * | 8/1952 | Wittmayer | 368/279 |
| 3,583,151 | A * | 6/1971 | Tissot et al. | 368/295 |
| 6,164,815 | A * | 12/2000 | Degonda | 368/278 |
| 6,490,886 | B1 * | 12/2002 | Steinhauer et al. | 63/15 |
| 7,035,171 | B2 * | 4/2006 | Hurni et al. | 368/232 |
| 7,111,978 | B2 * | 9/2006 | Gerber | 368/295 |
| 8,272,778 | B2 * | 9/2012 | Hiranuma et al. | 368/295 |
| 2007/0253290 | A1 * | 11/2007 | Aire | 368/294 |
| 2007/0274162 | A1 * | 11/2007 | Aire | 368/276 |
| 2011/0239704 | A1 * | 10/2011 | Babyak | 63/29.1 |

* cited by examiner

*Primary Examiner* — Sean Kayes
(74) *Attorney, Agent, or Firm* — Leydig, Voit & Mayer, Ltd.

(57) ABSTRACT

A timepiece case has a case body having a face and a central axis normal to the face, a bezel on the case body, and a releasable attachment device operatively releasably attaching the bezel to the case body. The releasable attachment device has a retainer and an operator for moving the retainer from an engaged position, in engagement with the bezel for retaining the bezel on the case body, to a disengaged position, disengaged from the bezel, for releasing the bezel.

20 Claims, 8 Drawing Sheets

TIMEPIECE CASE AND TIMEPIECE INCORPORATING THE SAME

The present invention relates to a case for a timepiece or particularly but not exclusively a wristwatch and to a timepiece incorporating the case.

BACKGROUND OF THE INVENTION

Timepieces and in particular wristwatches have a bezel on the face, which is an important part of a wristwatch at least insofar as aesthetic design is concerned.

It has been known that certain wristwatches allow a user to change the bezel, in that the bezel is screwed onto the watchcase and may be unscrewed therefrom for replacement by another bezel. In the other design, the bezel is pressed fit onto the watchcase and may be pried off by a level or wedge-like tool.

Such known bezel designs are imprecise or unreliable, and are invariably inconvenient to use. For those screw-on bezel designs, it is often difficult if not impossible to orient the bezel precisely at the right angle or to ensure firm fitting. The press-fit bezel designs suffer from the same disadvantages or shortcomings and additionally a separate tool is required, and that is inconvenient and the operation is not straightforward.

The invention seeks to mitigate or at least alleviate such disadvantages or shortcomings by providing a new or otherwise improved timepiece case and timepiece incorporating the same.

SUMMARY OF THE INVENTION

According to the invention, there is provided a timepiece case comprising a case body having a face and a central axis normal to the face, a bezel on the case body, and a releasable attachment device operatively releasably attaching the bezel on the case body. The releasable attachment device comprises a retainer and an operator for moving the retainer from an engaged position in engagement with the bezel for retaining the bezel to the case body to a disengaged position disengaged from the bezel for releasing the bezel.

Preferably, the releasable attachment device is provided on and connected to the case body.

Preferably, the releasable attachment device has a one-piece structure which has a first part providing the retainer and a second part providing the operator.

More preferably, the first and second parts are respective inner and outer parts of the one-piece structure with respect to the central axis.

It is preferred that the retainer includes a protrusion which operatively engages with the bezel through bodily engagement in the engaged position.

It is further preferred that the bezel has a step with which the protrusion operatively engages to engage with the bezel.

It is further preferred that the bezel has a recess with which the protrusion operatively engages to engage with the bezel.

Conveniently, the protrusion has an inclined surface facing the bezel for receiving the bezel upon attachment of the bezel to the case body, whereby the bezel is attached through a snap action.

In a preferred embodiment, the retainer is supported for pivotal movement between the engaged position and the disengaged position.

More preferably, the retainer is supported by a hinge pin for the pivotal movement, the hinge pin being provided between the retainer and the case body.

Further more preferably, the hinge pin has opposite ends in engagement or connection with the case body and an intermediate portion in engagement or connection with the retainer.

Further more preferably, the hinge pin is an integral part of the retainer.

It is preferred that the releasable attachment device includes a resilient biasing device resiliently biasing the retainer into the engaged position.

It is further preferred that the resilient biasing device comprises a coil spring compressed in a telescopically extendable casing having a part bearing against the operator.

It is further preferred that the resilient biasing device is located and co-acts between the operator and the case body.

In a preferred embodiment, the releasable attachment device is provided on the case body, and the bezel and the releasable attachment device have adjacent parts along their interface which inter-engage with each other against angular movement of the bezel about the central axis.

More preferably, the adjacent parts between the bezel and the releasable attachment device are of matching complementary shapes.

Further more preferably, the bezel has a recess adjacent to and accommodating the releasable attachment device.

It is preferred that the bezel is operatively attached to or released from the case body in a direction substantially parallel to the central axis.

It is preferred that the timepiece case includes a pair of the releasable attachment devices which are provided on the body at diametrically opposite positions about the central axis.

It is further preferred that the releasable attachment devices are located at the two and eight o'clock positions.

It is yet further preferred that the timepiece case includes two pseudo releasable attachment devices of the same appearance and size as the releasable attachment devices, located at the four and ten o'clock positions.

The invention also provides a timepiece in the form of a wristwatch incorporating the aforesaid timepiece case, including a time display device housed in the timepiece case.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
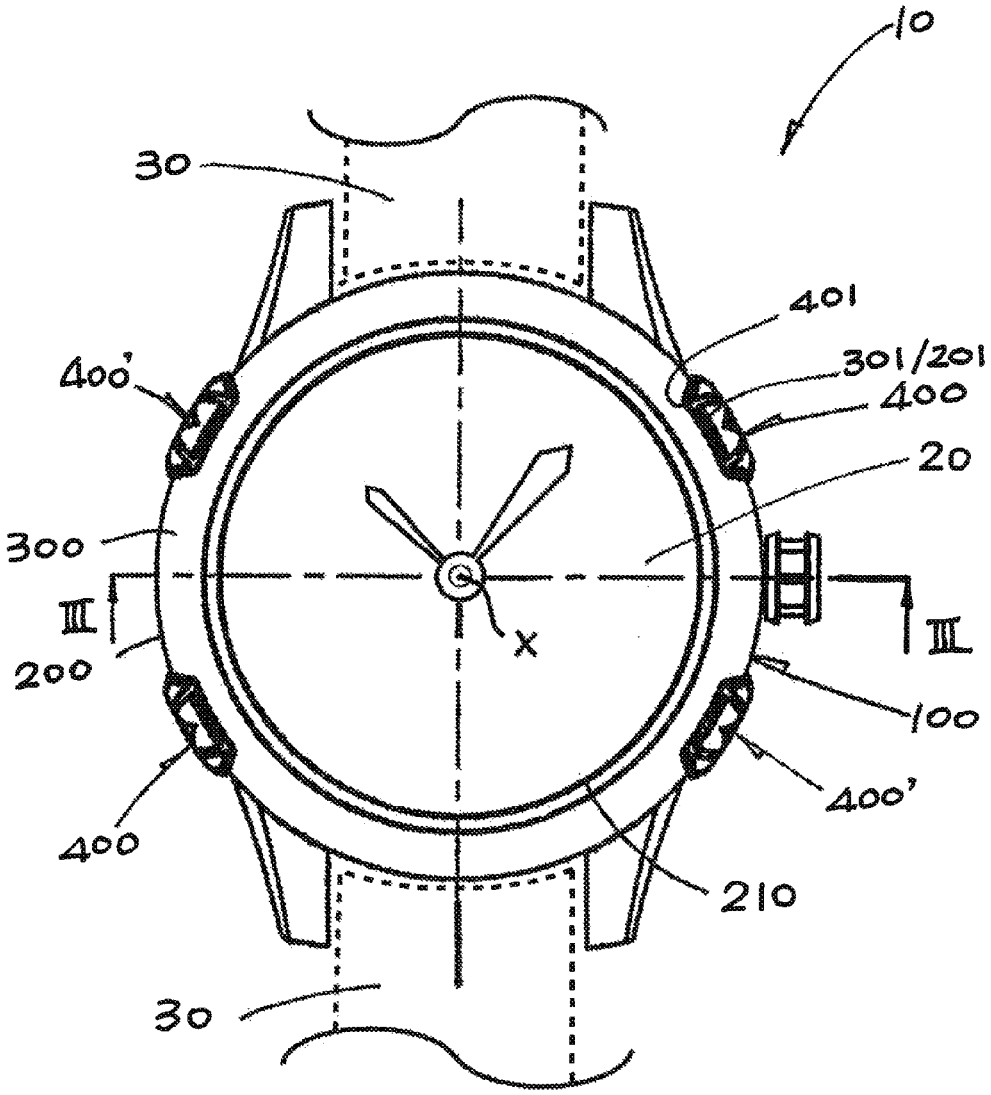
FIG. 1 is a front view of a timepiece in the form of a wristwatch that incorporates an embodiment of a timepiece or watch case in accordance with the invention.
Figure 2:
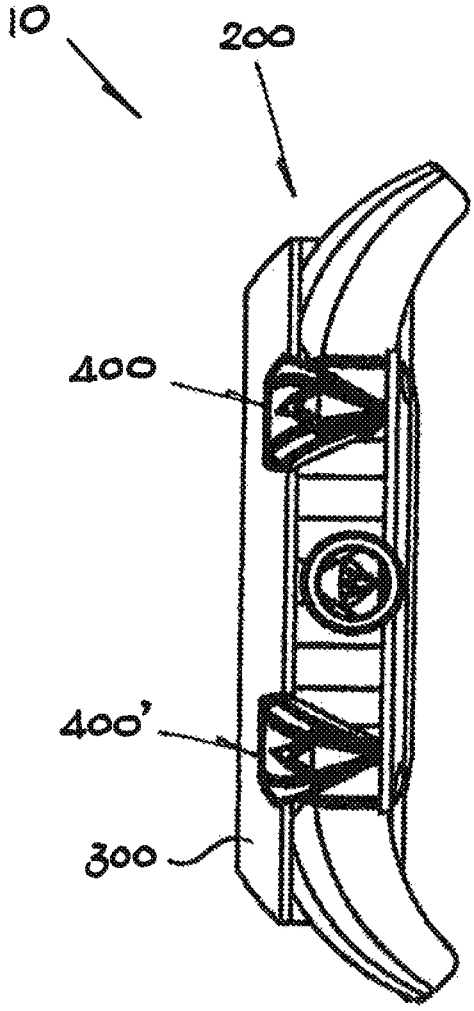
FIG. 2 is a right side view of the wristwatch of FIG. 1.
Figure 3:
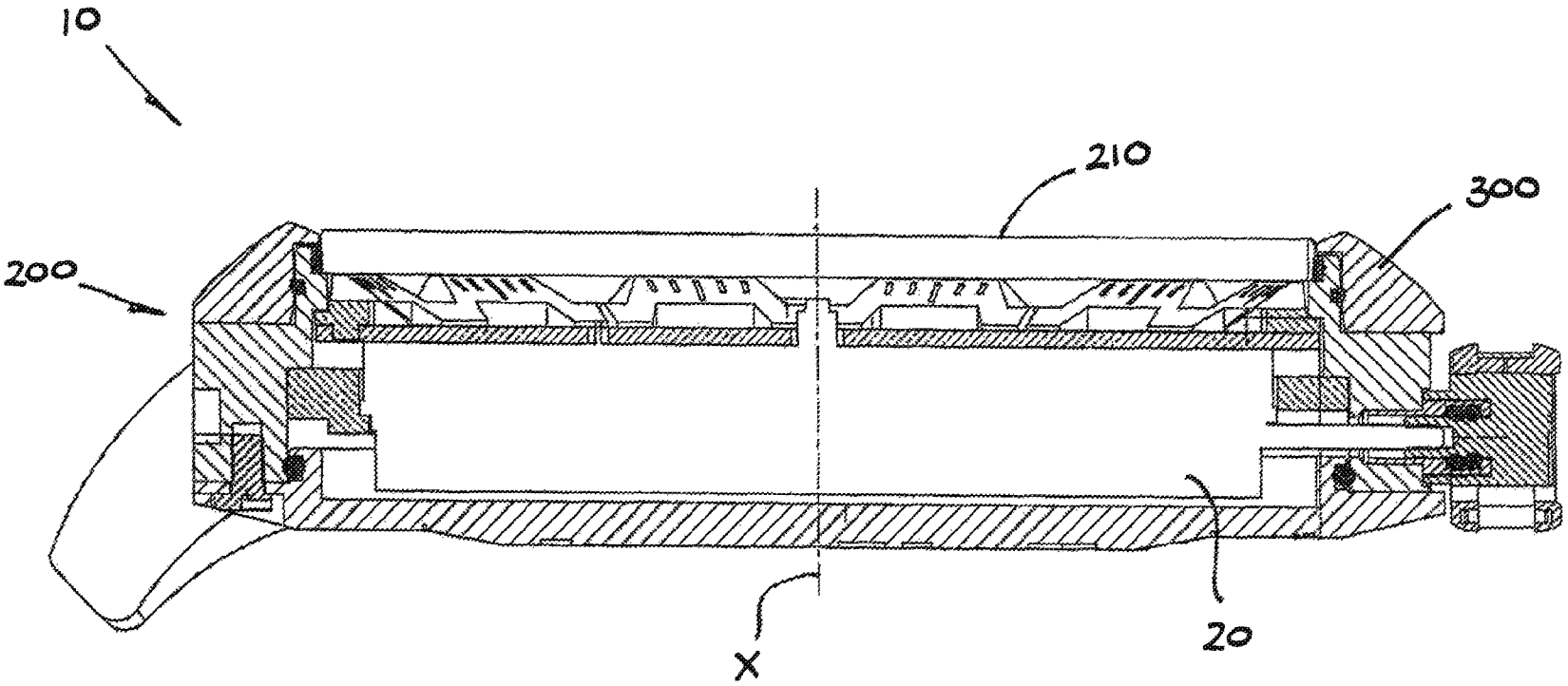
FIG. 3 is a cross-sectional side view of the wristwatch of FIG. 1, taken along line
Figure 4:
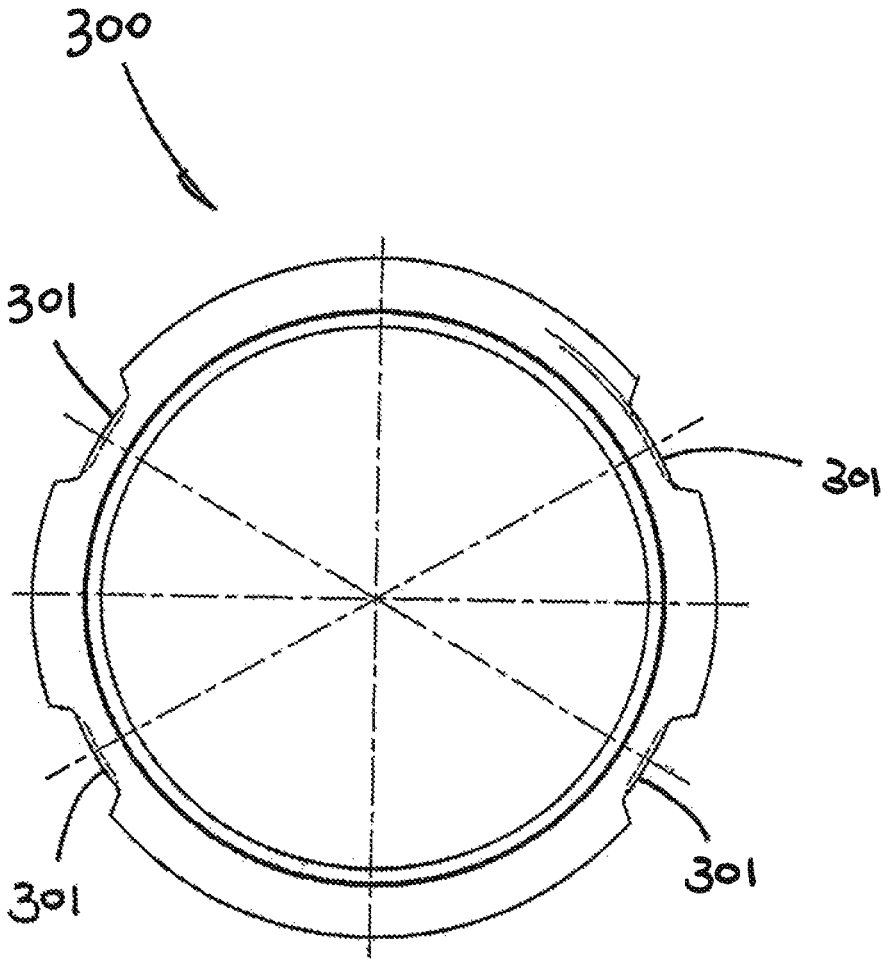
FIG. 4 is a front view of a bezel of the wristwatch of FIG. 1.
Figure 5:
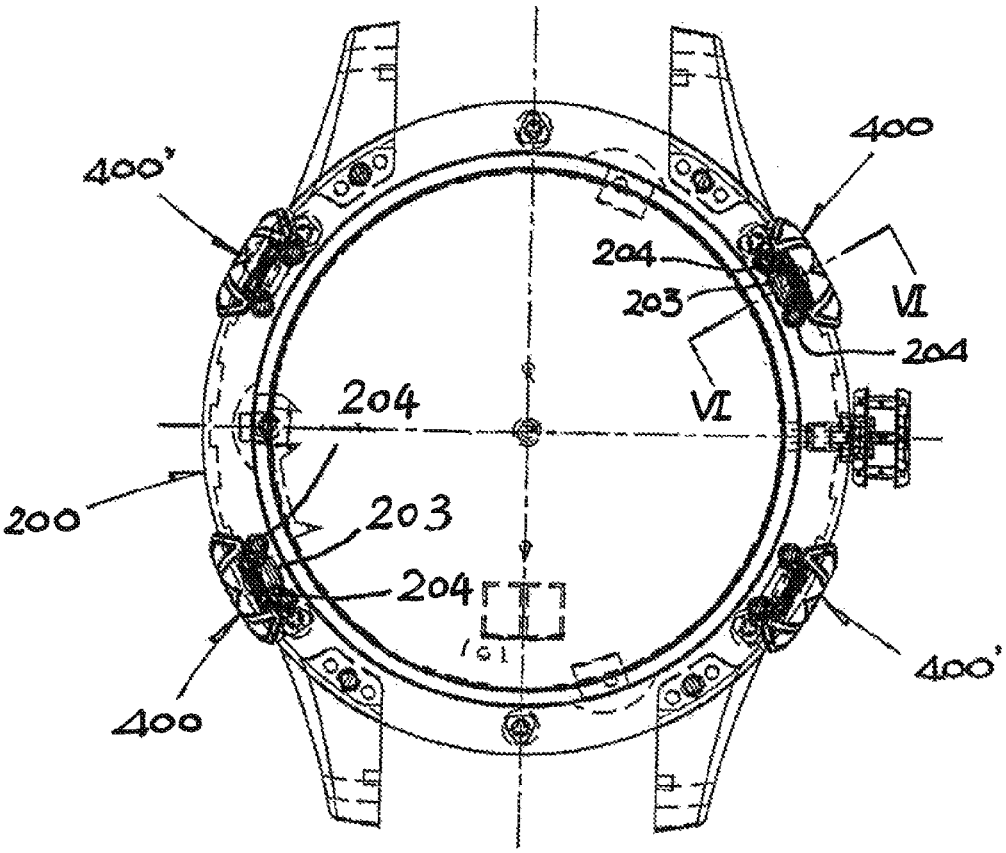
FIG. 5 is a front view of the wristwatch of FIG. 1 without showing the bezel.
Figure 7:
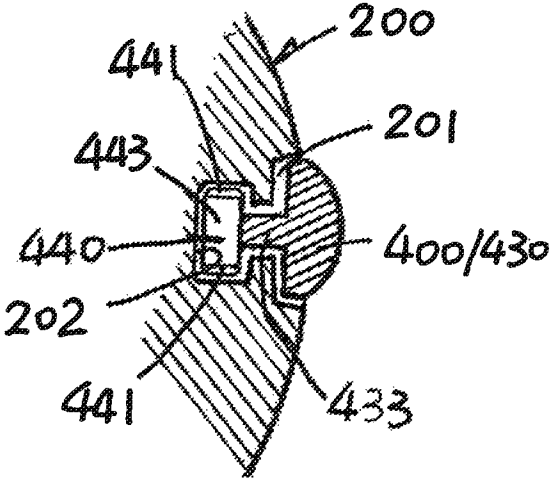
FIG. 7 is a fragmentary cross-sectional side view of the wristwatch of FIG. 6 taken along line VII-VII, showing a releasable attachment device.
Figure 6:
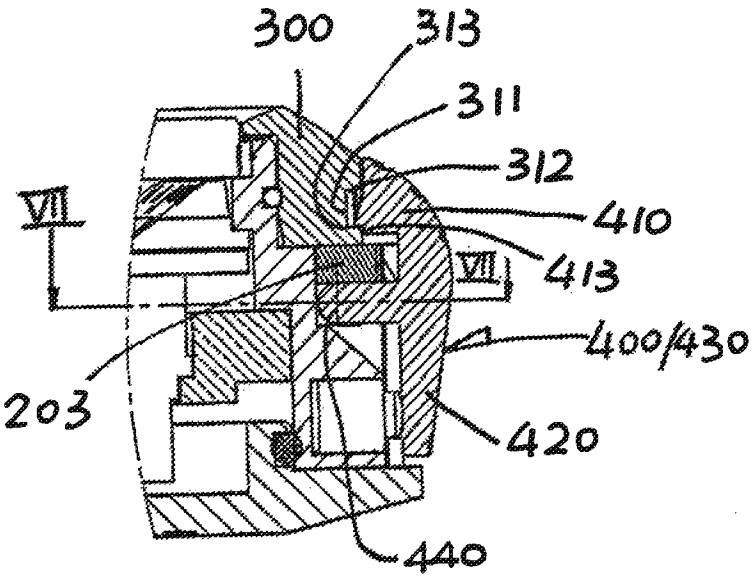
FIG. 6 is a fragmentary cross-sectional side view of the wristwatch of FIG. 5 taken along line VI-VI, showing a releasable attachment device.
Figure 8:
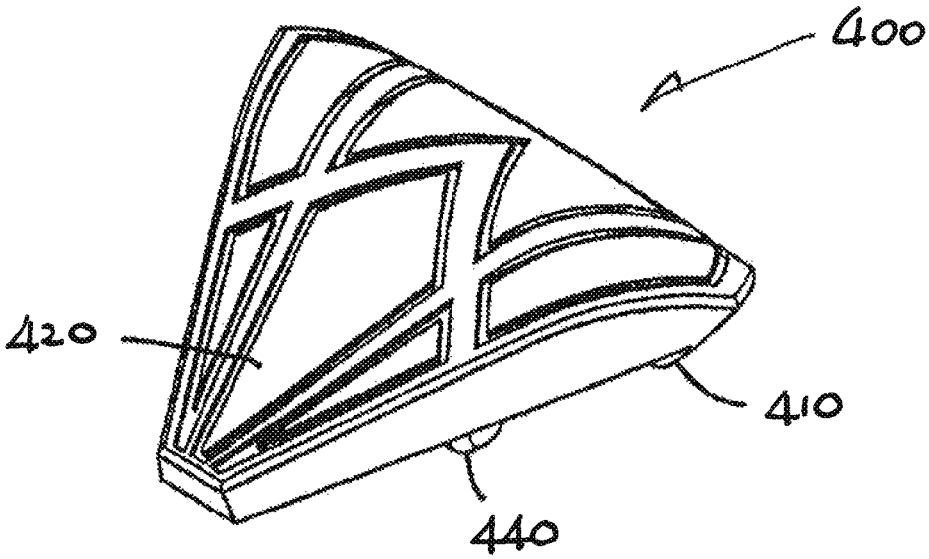
FIG. 8 is a front perspective view of the releasable attachment device of FIGS. 6 and 7.
Figure 9:
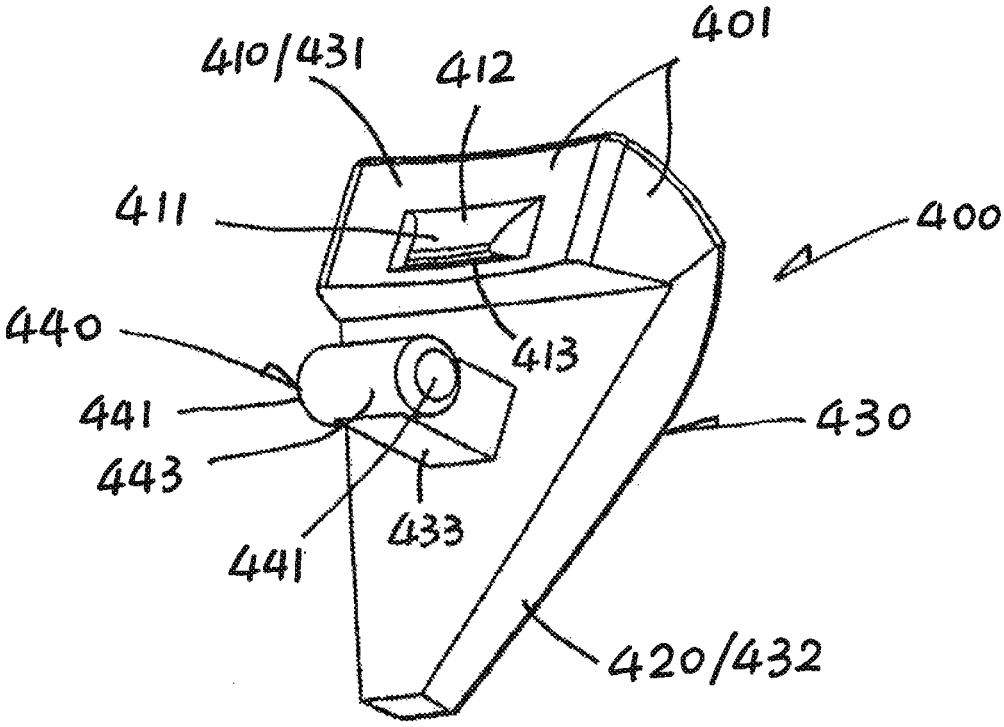
FIG. 9 is a rear perspective view of the releasable attachment device of FIG. 8.
Figure 10:
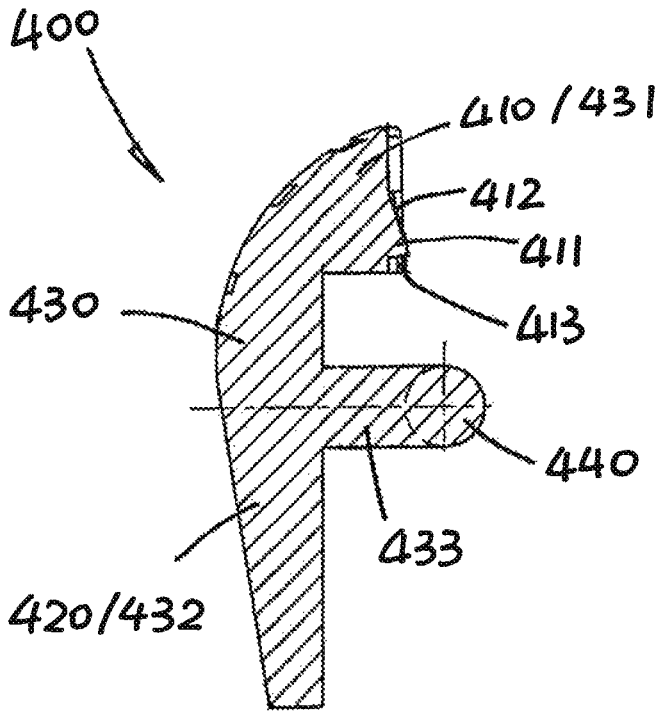
FIG. 10 is a cross-sectional right side view of the releasable attachment device of FIG. 8.
Figure 11:
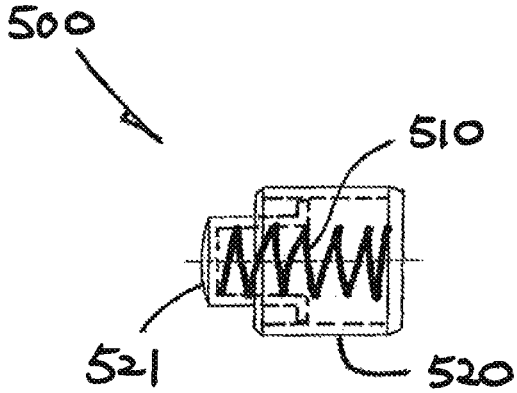
FIG. 11 is a see-through side view of a resilient biasing device for the releasable attachment device of FIG. 8.

Referring to FIGS. 1 to 11 of the drawings, there is shown a timepiece in the form of a wristwatch 10 which incorporates a timepiece/watch case 100 embodying the invention. The wristwatch 10 includes an analogue (or digital) time display mechanism 20 housed in the watch case 100 and a pair of watch straps 30 connected to opposite sides of the watch case 100. The watch case 100 has a case body 200 having a face (i.e. watch face) 210 and a central axis X normal to the face 210, a bezel 300 on the case body 200 and extending around the face 210, and at least one releasable attachment device 400 operatively releasably attaching the bezel 300 on the case body 200. In this embodiment, the watch case 100 incorporates a pair of the releasable attachment devices 400, which are provided on and connected to the case body 200 at diametrically opposite positions about the central axis X and, in particular, are located at the two and eight o'clock positions. There are also two pseudo releasable attachment devices 400' of the same appearance and size as the releasable attachment devices 400, located at the four and ten o'clock positions. These functional and pseudo attachment devices 400 and 400' are located partially within respective side recesses 201 of an identical shape and formed around the periphery of the case body 200.

Generally stated, each releasable attachment device 400 comprises a retainer 410 and an operator 420 for moving the retainer 410 from an engaged position in engagement with the bezel 300 for retaining the bezel 300 to the case body 200 to a disengaged position disengaged from the bezel 300 for releasing the bezel 300. Each releasable attachment device 400 is a one-piece structure which has a first part providing the retainer 410 and a second part providing the operator 420, with the first and second parts being inner and outer parts respectively of the one-piece structure with respect to the central axis X. That is to say, the retainer 410 faces inwardly the bezel 300 and the operator 420 faces outwardly from the bezel 300 and hence exposed for manual operation i.e. pressing.

The bezel 300 is releasably attached to the case body 200 such that it can be detached and be replaced by another bezel of the same construction but a different design, for example to suit the costume of a user of the wristwatch 10 in a specific day or as the user desires. Fitting of the bezel 300 is a simple and quick task, with the bezel 300 being easily detachable and a replacement bezel firmly attachable. It is particularly advantageous that the bezel 300 is operatively attached directly onto or released straight from the case body 200 in a direction substantially parallel to the central axis X, i.e. without turning or angular movement about the axis X.

To achieve this, with the releasable attachment devices 400 being provided on the case body 200 in fixed positions, the bezel 300 and each releasable attachment device 400 have along their interface adjacent parts or portions 301 and 401 which inter-engage or interlock with each other against angular movement of the bezel 300 about the central axis X. In this specific embodiment, the bezel 300 has on its outer side a recess 301 as its part 301 which is adjacent to the releasable attachment device 400, whose adjacent near side portion 401 is of a matching complementary cross-sectional shape relative to the recess 301, and accommodates the near side portion 401 of the releasable attachment device 400. The matching complementary cross-sectional shapes are generally flat trapezoidal as shown.

As to construction, each releasable attachment device 400 has a body in the form of an inverted triangular platelet 430 positioned generally upright. The retainer 410 and the operator 420 are provided by an upper part 431 and a lower part 432 respectively of the platelet 430, which includes a middle part 433 that projects horizontally rearward. The middle part 433 is integrally formed at its free end with a horizontal hinge pin 440 as an integral part extending parallel to the plane of the platelet 430.

The releasable attachment device 400, or in particular the retainer 410 is supported by the hinge pin 440 for pivotal movement between the engaged position and the disengaged position. Being provided between the retainer 410 and the case body 200, the hinge pin 440 pivotably connects the retainer 410 to the case body 200 at a position partially within the relevant side recess 201.

The hinge pin 440 has opposite ends 441 engaged or connected with the case body 200 and an intermediate portion 443 in engagement or, in this particular embodiment, integral connection with the retainer 410. For connecting the hinge pin 440, the case body 200 is formed with a horizontal T-shaped recess 202 adjoining and directly behind the associated side recess 201. The recess 202 receives and accommodates the hinge pin 440 and the platelet's middle part 433 in a loose fit manner, and is then closed by a small horizontal strip 203 secured by screws 204 at both ends to the case body 200.

The releasable attachment device 400 is pivotable about the hinge pin 440 like a lever.

The retainer 410 has a vertical surface facing inwards and a protrusion 411 on this surface. The protrusion 411 is of a flat triangular cross-section extending upright, having an inclined upper side 412 and a horizontal lower side 413. The upper side 412 is inclined to the vertical surface at a small angle, and the lower side 413 at an angle of 90° to provide a right-angled hook 413, with which the retainer 410 in the engaged position operatively engages with the bezel 300 through bodily engagement i.e. hooking engagement.

For engagement, the bezel 300 is formed with a recess 311 at the lower end of the recess 301 that accommodates the releasable attachment device 400 concerned. The recess 311 provides an upper step 312 and a lower step 313, with which lower step 313 the protrusion 411 operatively engages by its hook 413 in order to engage with and thus retain the bezel 300 on the case body 200.

The releasable attachment device 400 includes a resilient biasing device 500 which resiliently biases the retainer 410 to pivot about the hinge pin 440 inwards into the engaged position.

The resilient biasing device 500 is implemented by a coil spring 510 encased and compressed in a telescopically extendable casing 520 which in turn has a part in the form of a plunger 521 bearing against the operator 420. The resilient biasing device 500 is located and co-acts between the operator 420 and the case body 200, at a horizontal position immediately behind the operator 420, adjacent the lower end thereof opposite the retainer 410 about the hinge pin 440. The plunger 521 bears against the lower end of the operator 420 to bias resiliently the retainer 410 inwards into the engaged position.

To detach the bezel 300 from the case body 200, it is only necessary for a user to use his/her thumb and index finger to press upon the operators 420 at the lower ends of the releasable attachment devices 400 (against the action of the springs 510) at the eight and two o'clock positions respectively. Inward pressing of the operators 420 results in the associated retainers 410 being pivoted outwards to withdraw or disengage their hooks 413 from the steps 313 of the bezel 300, whereupon the bezel 300 is released and may be removed by e.g. turning the wristwatch 10 over to drop the bezel 300.

To re-attach the bezel 300 (or another bezel of the same construction but different design), it is only necessary to press the operators 420 again and/or keep them pressed and then fit the bezel 300 over the case body 200 at the right angular position as determined by the position of the attachment devices 400 and 400'. Upon lowering of the bezel 300 onto the case body 200, the attachment devices 400 are released so that the retainers 410 and in particular their hooks 413 re-engage with the steps 313 of the bezel 300, whereupon the bezel 300 is attached firmly and at the right orientation.

Alternatively, the bezel 300 may simply be pressed at the right angular position down onto the case body 200, without the operators 420 being pressed. The bottoms of the bezel 300 at its recess 301 will engage (i.e. hit) the inclined upper sides 412 of the protrusions 411 of the respective retainers 410, thereby pushing to pivot the retainers 410 outwards through a cam action (against the action of the springs 510). Upon the bezel 300 reaching lowermost, the retainer's hooks 413 will ride round and latch with the corresponding steps 313 in a snap action, as the retainers 410 return or snap back under the action of the springs 510. The bezel 300 is attached through a snap action that is quick and easy, though this may not be advisable to avoid scratches or damage to the bezel 300.

The pseudo attachment devices 400' may be fixed i.e. not pivotable at all, and serve to balance the arrangement of the attachment devices 400 and 400'.

It is envisaged that in the simplest construction, it is possible to make use of only one releasable attachment device 400 to attach or hold the bezel 300 on the case body 200.

The invention has been given by way of example only, and various other modifications of and/or alterations to the described embodiment may be made by persons skilled in the art without departing from the scope of the invention as specified in the appended claims.

The invention claimed is:

1. A timepiece case comprising:

a case body having a face and a central axis normal to the face;

a bezel on the case body;

a pair of releasable attachment devices operatively releasably attaching the bezel to the case body, wherein each of the releasable attachment devices comprises a retainer and an operator for moving the retainer from an engaged position, in engagement with the bezel for retaining the bezel on the case body, to a disengaged position disengaged from the bezel for releasing the bezel, and the releasable attachment devices are respectively located at two o'clock and eight o'clock positions, diametrically opposite each other, about the central axis; and two pseudo releasable attachment devices, each pseudo releasable attachment device having the same appearance and size as each of the releasable attachment devices, wherein the pseudo releasable attachment devices are respectively located at four o'clock and ten o'clock positions, diametrically opposite each other, about the central axis.

2. The timepiece case as claimed in claim 1, wherein the releasable attachment devices are located on and connected to the case body.

3. The timepiece case as claimed in claim 1, wherein each of the releasable attachment devices has a one-piece structure including a first part providing the retainer and a second part providing the operator.

4. The timepiece case as claimed in claim 3, wherein the first and second parts are respective inner and outer parts of the one-piece structure, with respect to the central axis.

5. The timepiece case as claimed in claim 1, wherein the retainer includes a protrusion which operatively engages the bezel through bodily engagement in the engaged position.

6. The timepiece case as claimed in claim 5, wherein the bezel has a step with which the protrusion operatively engages to engage the bezel.

7. The timepiece case as claimed in claim 5, wherein the bezel has a recess with which the protrusion operatively engages to engage the bezel.

8. The timepiece case as claimed in claim 5, wherein the protrusion has an inclined surface facing the bezel for receiving the bezel upon attachment of the bezel to the case body, and the bezel is attached through a snap action.

9. The timepiece case as claimed in claim 1, wherein the retainer is supported for pivotal movement between the engaged position and the disengaged position.

10. The timepiece case as claimed in claim 9 including a hinge pin, wherein the retainer is supported by the hinge pin for the pivotal movement, and the hinge pin is located between the retainer and the case body.

11. The timepiece case as claimed in claim 10, wherein the hinge pin has opposite ends in engagement or connection with the case body, and an intermediate portion in engagement or connection with the retainer.

12. The timepiece case as claimed in claim 10, wherein the hinge pin is an integral part of the retainer.

13. The timepiece case as claimed in claim 1, wherein each of the releasable attachment devices includes a resilient biasing device resiliently biasing the retainer toward the engaged position.

14. The timepiece case as claimed in claim 13 including a telescopically extendable casing having a part bearing on the operator, wherein the resilient biasing device comprises a coil spring compressed in the telescopically extendable casing.

15. The timepiece case as claimed in claim 13, wherein the resilient biasing device is located and co-acts between the operator and the case body.

16. The timepiece case as claimed in claim 1, wherein the releasable attachment devices are located on the case body, and the bezel and the releasable attachment devices have adjacent parts along an interface and engaged each other to prevent angular movement of the bezel about the central axis.

17. The timepiece case as claimed in claim 16, wherein the adjacent parts have matching complementary shapes.

18. The timepiece case as claimed in claim 17, wherein the bezel has a recess adjacent to and accommodating the releasable attachment devices.

19. The timepiece case as claimed in claim 1, wherein the bezel is operatively attached to or released from the case body in a direction substantially parallel to the central axis.

20. A timepiece in the form of a wristwatch incorporating the timepiece case as claimed in claim 1, including a time display device housed in the timepiece case.

* * * * *